United States Patent [19]

Halm

[11] 4,279,113

[45] Jul. 21, 1981

[54] COIN GUARD FOR COIN PROTECTION

[76] Inventor: Immanuel Halm, 865 E. Decker Dr., Seven Hills, Ohio 44131

[21] Appl. No.: 94,844

[22] Filed: Nov. 16, 1979

[51] Int. Cl.[3] ..... B65B 51/10; B65B 51/12

[52] U.S. Cl. ..... 53/219; 53/463; 53/373; 53/390; 156/583.3; 156/583.9; 219/466

[58] Field of Search ..... 53/373, 329, 204, 463, 53/464, 452, 453, 219, 390; 156/583.3, 583.9; 219/466, 477, 478, 352, 386

[56] References Cited

U.S. PATENT DOCUMENTS

| | | | |
|---|---|---|---|
| 2,557,975 | 6/1951 | King | 53/373 |
| 3,190,051 | 6/1965 | Souligney | 53/373 X |
| 3,277,279 | 10/1966 | Wei | 219/466 X |
| 3,381,450 | 5/1968 | Monks | 53/373 X |
| 3,420,034 | 1/1969 | Saraisky et al. | 53/373 X |
| 3,479,789 | 11/1969 | Harrison | 53/463 |
| 3,488,472 | 1/1970 | Pizarro | 53/373 X |
| 3,772,850 | 11/1973 | Fujiwara | 53/373 X |

*Primary Examiner*—Horace M. Culver
*Attorney, Agent, or Firm*—W. Britton Moore

[57] ABSTRACT

A device for encasing coins in protective envelopes embodying a generally rectangularly contoured housing elevated at one end and stepped down intermediate its ends to provide a flat work surface offsetedly spaced below the elevated end, with insulation flatly superposed on the work surface thereof and heating coils embedded therein and encircling a centrally disposed coin receiving area. A generally rectangular forming member pivotally mounted to the elevated housing end and overlying and elevatable relative to the work surface. With a coin sandwiched between two sheets of plastic and disposed in the coin area, the forming member is actuated downwardly to compress the plastic sheets over and around the coin and against the flat work surface, and switching pin means on the forming member coacts with selective switching means to make contact with and energize a selected heating coil so that the heat therefrom circumferentially severs the plastic sheets around the coin and the latter is encased in a compact circular package conforming to the size of the coin.

2 Claims, 5 Drawing Figures

COIN GUARD FOR COIN PROTECTION

CROSS REFERENCE TO PRIOR ART AND TO DISCLOSURE DOCUMENT

No anticipatory prior art patents, literature or other references are known that teach or suggest the present invention, but Applicant's invention is the subject of a Disclosure Document No. 080,561, dated May 23, 1979 in the U.S. Patent and Trademark Office.

U.S. patents noted as being of cursory interest to the invention are:

| INVENTOR | PATENT NO. |
|---|---|
| Levy | 3,100,567 |
| Weir | 3,302,773 |
| Harrison | 3,597,894 |
| Harrison | 3,809,217 |

BRIEF SUMMARY OF THE INVENTION

The present invention relates to an improved device for use by numismatists and dealers in individually displaying and storing small coins and the like of various sizes in generally flat circular thermal sealed packages. More particularly, the device functions to package generally flat coins in airtight, small, permanent, flat thermal sealed packages generally approximating the shape of each coin and wherein the excess material from the plastic covering sheets is severed therefrom during a heat sealing operation so that each coin is individually and completely packaged for viewing.

FIELD OF THE INVENTION

The invention has the advantage of encasing generally flat circular coins in separate, permanent and individually arranged, thermal sealed, airtight packages by press heat sealing two sheets of thermoplastic in a sequence wherein the excess material is so removed during heat sealing that each coin is encased in a compact package corresponding generally to the contour of the coin. The operation sequence is as follows:

1. Set a selector switch according to the desired size of the coin to be packaged;
2. Lay the coin or work piece between two sheets of thermoplastic centrally on the work surface;
3. Pivot and press the forming member downwardly relative to the coin interposed between the thermoplastic sheets for a period of five seconds indicated by a signal light, at which time the forming member is elevated;
4. After cooling, the coin will be encased and sealed permanently and airtightly within the protective package ready for handling or insertion with a suitable coin holder.

SUMMARY OF THE INVENTION

An advantage and benefit of the invention is that the device hereof serves to thermally seal and encase generally flat circular coins between thermoplastic sheets into similarly contoured airtight packages which will protect coins from becoming soiled and tarnished from exposure and handling.

A further advantage of the present invention is to provide an airtight, thermally sealed, compact, coin encasing package that preserves the mint condition of and protects the coin from moisture, perspiration, and contact with the hands during handling and storage.

Another object of the present invention is the provision of a device for use by numismatists in protectively encasing and sealing coins in circular airtight packages. Usually coins may be packaged and dispensed in packages of about twelve coins, whereas in the device hereof the coins are not handled en masse but are separately or individually handled and packaged for storage or exhibition in a suitable coin holder, such as illustrated in U.S. Pat. No. 3,100,567.

Still another advantage of the invention is that disposal of each coin in an airtight package protects and prevents the coins from becoming tarnished as air is excluded therefrom. While copper pennies and clad coins usually tarnish over a period of time, cleansing thereof usually damages some of the mint luster originally available on the coin surface. Although some coins, such as those of silver and gold can be dipped in a cleansing solution, this method is not advisable for clad or copper coins, and the device hereof provides single coin packages wherein the original mint luster thereof is preserved.

BRIEF DESCRIPTION OF THE SEVERAL DRAWINGS

The above and other objects and advantages of the invention will become apparent upon full consideration of the following detailed description and accompanying drawings in which.

DETAILED DESCRIPTION OF THE PREFERRED EMBODIMENTS OF THE INVENTION

Figure 1:
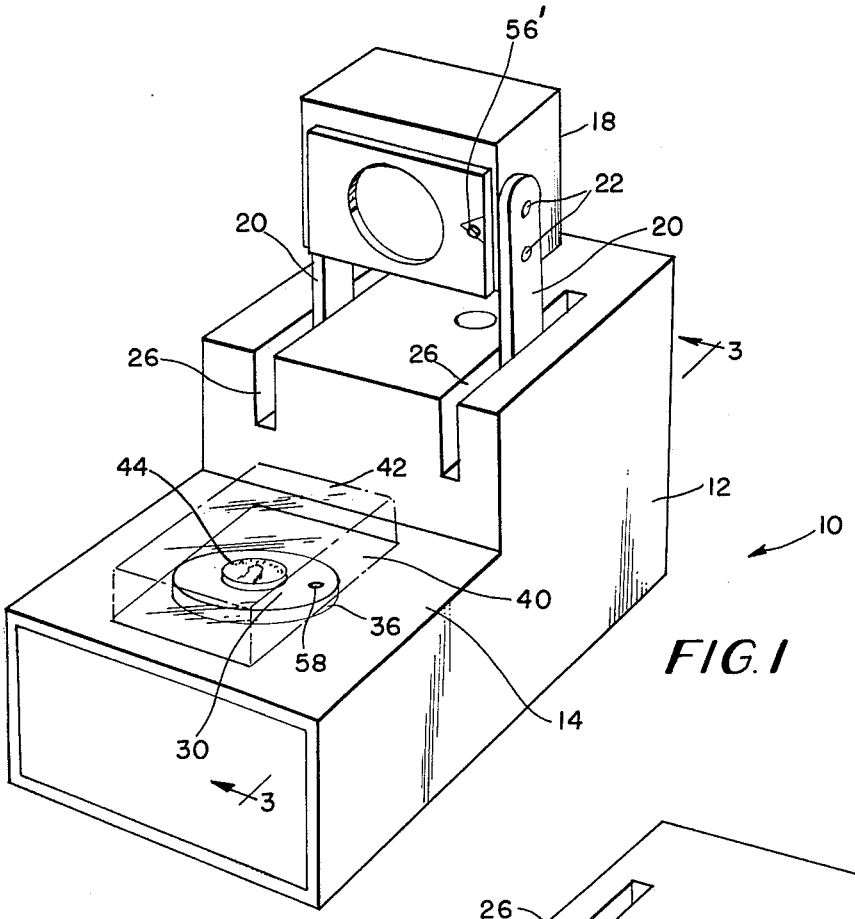
FIG. 1 is a front upper perspective view of the preferred embodiment of the coin guard packaging or encasing apparatus.
Figure 2:
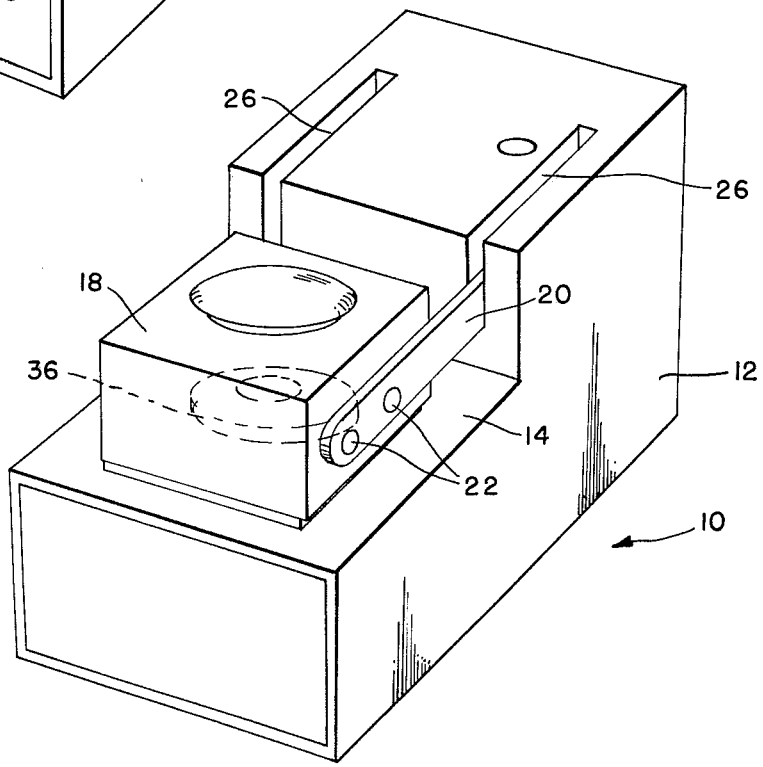
FIG. 2 is a further perspective view showing an upper pivoted forming member lowered into thermal heat sealing position.

Referring now to the drawings there is shown a generally L-shaped housing 12 formed with an upwardly extending rear end projecting above the forward portion thereof so that it is stepped down, intermediate its ends, to provide a generally flat horizontal work surface 14, spaced below the flat rear horizontal upper end. A generally rectangular forming member or pressing block 18 is normally retained in elevated FIG. 1 position above the rear upper end of housing 12 by levers 20, fixedly attached to the opposing side walls by rivets or the like 22. The levers 20 are received within vertically disposed slots 26, arranged in the upper rear end of the housing and extending from points spaced from the rear end to the front wall thereof. The lower ends of the levers 20 are suitably pivotally mounted (FIG. 3) within the slots 26 so that, during forward arcuate pivotal movement of forming member 18, from the position of FIG. 1 to that of FIG. 2, as presently to be described, the levers will be received within the slots 26.

A generally flat block 36 of suitable insulation material is disposed on the horizontal work surface 14 so as to provide a central coin receiving area 30 on the upper surface thereof. A wire heating coil 32 is suitably arranged on the flat upper surface of block 36 and encircles the coin receiving area 30. Flatly arranged on the upper surface of insulation block 36 is a generally rectangular sheet of thermoplastic material 40 which is so dimensioned as to project beyond and be spaced from wire coil 32, and a coin 44 to be packaged is centrally and flatly disposed thereon. A corresponding thermoplastic second sheet 42 is flatly disposed on the upper coin surface so that the marginal edges of the two sheets 40–42 coincide.

Figure 3:
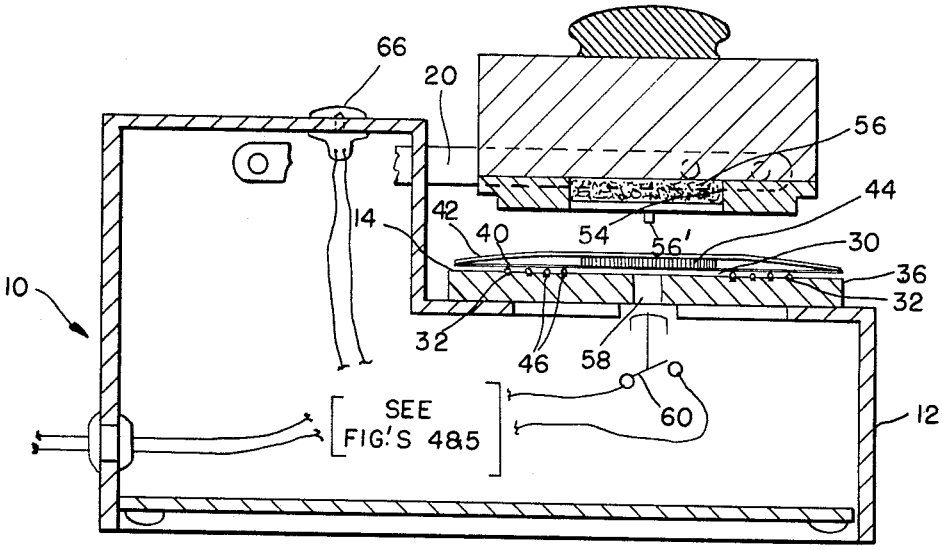
Figure 4:
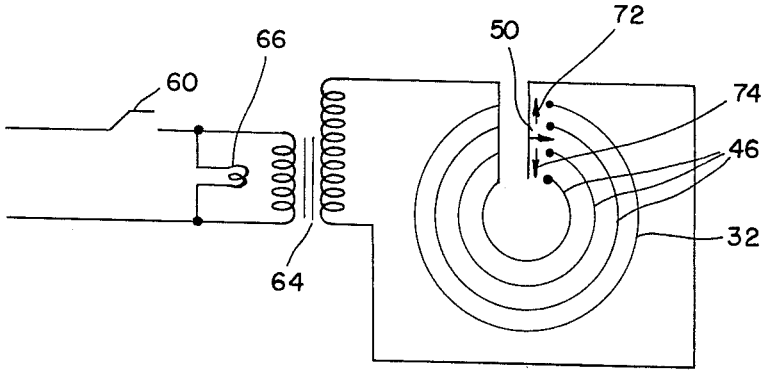
FIGS. 4 and 5 show the thermal heat sealing circuits hereof.
Figure 5:
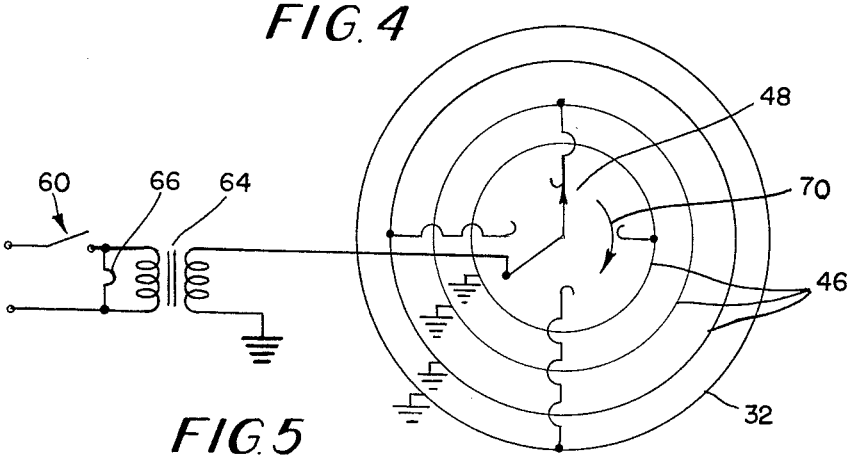

It is to be noted that the lower and upper sheets 40–42 extend outwardly beyond the circularly arranged wire heating coil 32, and additional and small concentric wire heating coils 46, such as the three shown in FIGS. 3–5, may be arranged inwardly of and respectively spaced from coil 32 and each other. Selective switch means 48 or 50, shown in FIGS. 4 and 5, may be utilized, as presently described, to selectively energize the respective coils 32–46, in a conventional manner as diagrammatically illustrated to effect sealing and packaging of the coin, as presently will be apparent.

Centrally formed in the bottom face of the forming member or pressing block 18, or in a plate suitably affixed thereto, is a circular recess 54 within which is seated a sponge pad 56, as best shown in FIG. 3. Upon downward movement of block 18, recess 54 will extend over the coin 44 and the pad 56 will engage with and press the upper thermoplastic sheet 42 against the upper coin surface and compress the underside of the coin against the bottom sheet 40. When this pressing movement of the block 18 is completed, as in FIG. 2, a vertical pin 56[1], suitably mounted adjacent a side bottom edge of the block, will project downwardly into an opening 58 through insulation block 36, offset with respect to the central coin receiving area, and into closing engagement with a switch 60 (FIGS. 3–5), suitably arranged within the housing 12, for energizing the coil 32. The latter is electrically coupled to a source of power and switch 60 through a suitably conventional transformer 64, as best shown in FIGS. 4 and 5.

FIG. 4 illustrates an arrangement in which the switch 50 may slide for selecting an appropriate size coil 32–46 that relates in size to the size of the coin being packaged, and the switch may have a handle or knob (not shown) that extends through a wall of the housing 12 in an obvious manner. An indicator light 66, also suitably arranged in the housing, indicates when current is being supplied to a preselected coil 32–46.

FIG. 5 shows similarly an arrangement for switching the coils 32–46 selectively, as is diagrammatically illustrated, with the switch being rotative, as indicated by the arrow 70. The switch 50 in FIG. 4 is laterally oriented and moves according to the arrows 72 or 74, as desired.

It is seen that the selector switch 48 or 50 is arranged for selectively energizing any one of the circularly disposed heating wires 32–46 within the housing 12 and in which there is the primary and secondary windings of the transformer described above. The secondary winding is connected to a selector switch for energizing the coil so that the coil sufficiently heats and effects a thermoplastic coupling between the sheets 40–42 of thermoplastic material so that the coin 44 is rendered waterproof, airtight and is protectively housed within a sealed thermoplastic casing.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. In a device for protectively encasing and packaging coins for handling and display, comprising a generally rectangular hollow housing having one end elevated and being offset downwardly, intermediate the ends, thereof to provide a generally flat horizontal work surface below said elevated end, a generally rectangular forming member pivotally mounted to said elevated end and elevatable relative to said work surface, generally circular resilient pad means arranged on said forming member, insulation means flatly arranged on said work surface and having a generally centrally disposed coin receiving area, a plurality of heating coils arranged in said insulation means and spacedly encircling said coin receiving area, said device adapted to support a first thermoplastic sheet flatly disposed on said insulation means, a coin generally centrally flatly arranged on said first sheet, and a second thermoplastic sheet superposed on said coin and generally coinciding with said first sheet, whereby when said forming member is pivotally lowered relative to said work surface said pad means will engage and compress said second and first sheets and the coin therebetween against said insulation means and a heating coil thereof, a main switch means connected to a power source, and selector switch means for selectively energizing said coils, transformer means in said housing having primary and secondary windings, means coupling said secondary winding to said selector switch means, and means connecting said primary winding to said main switch for energizing a preselected one of said heating coils to encirclingly thermally bond said sheets together and encase said coin therebetween in a package conforming to the size of coin.

2. In a device according to claim 1, wherein said pad means is centrally arranged in a recess in a bottom surface of said forming member, and having indicator lamp means coupled across the primary winding of said transformer and so connected to indicate when said transformer is energized.

* * * * *